United States Patent [19]

Miyagi

[11] 4,401,086

[45] Aug. 30, 1983

[54] METHOD OF AND APPARATUS FOR CONTROLLING AN AIR RATIO OF THE AIR-FUEL MIXTURE SUPPLIED TO AN INTERNAL COMBUSTION ENGINE

[75] Inventor: Hideo Miyagi, Okazaki, Japan

[73] Assignee: Toyota Jidosha Kogyo Kabushiki Kaisha, Toyota, Japan

[21] Appl. No.: 258,572

[22] Filed: Apr. 29, 1981

[30] Foreign Application Priority Data

Nov. 7, 1980 [JP] Japan ..... 55-155813

[51] Int. Cl.[3] ..... F02D 5/00

[52] U.S. Cl. ..... 123/489; 123/440

[58] Field of Search ..... 123/489, 440; 60/276, 60/285

[56] References Cited

U.S. PATENT DOCUMENTS

| | | | |
|---|---|---|---|
| 4,120,270 | 10/1978 | Asano et al. | 123/440 |
| 4,163,433 | 8/1979 | Fujishiro | 123/440 |
| 4,224,910 | 9/1980 | O'Brien | 123/489 |
| 4,228,775 | 10/1980 | Schweikert | 123/489 |
| 4,244,340 | 1/1981 | Herth et al. | 123/489 |
| 4,300,505 | 11/1981 | Takada et al. | 123/489 |

*Primary Examiner*—Charles J. Myhre
*Assistant Examiner*—Andrew M. Dolinar
*Attorney, Agent, or Firm*—Cushman, Darby & Cushman

[57] ABSTRACT

An air-fuel ratio control device includes an oxygen concentration detector which issues a signal indicating a lean mixture, hereinafter known as a lean signal, and a signal indicating a rich mixture, hereinafter known as a rich signal. An electronic control unit is provided for converting the lean and rich signals to a signal indicating injection control, hereinafter known as an injection control signal. The level of the injection control signal is incrementally changed by a first value when the output signal of the oxygen concentration detector is changed from the rich signal to the lean signal. The level of the drive control signal is incrementally changed by a second value, which is larger than the first value, when the output signal of the oxygen concentration detector is changed from the lean signal to the rich signal. When the output signal of the oxygen concentration detector is changed from the lean signal to the rich signal, immediately after it is changed from the rich signal to the lean signal, the level of the drive control signal is changed by the first value.

14 Claims, 7 Drawing Figures

14
RAM
61
ROM
62
MPU
60
I/O PORT
63
I/O PORT
64
AD CONVERTER
73
ANALOG MULTIPLEXER
72
COMPARATOR
76
DETECTING LEVEL CONVERTOR
79
BUFFER
69
BUFFER
70
BUFFER
71
BUFFER
75
BUFFER
77
BUFFER
78
AIR FLOW METER
17
WATER TEMPERATURE SENSOR
45
AIR TEMPERATURE SENSOR
47
OXYGEN CONCENTRATION DETECTOR
46
CYLINDER DISCRIMINATING SENSOR
43
ROTATING SPEED SENSOR
44

INTERRUPTION ROUTINE
100
IS THE LEAN SIGNAL ISSUED ?
101
YES
NO
IS RICH FLAG SET ?
102
YES
NO
RICH FLAG IS RESET
103
F(A/F)←F(A/F)+K
111
A ← A + 1
112
IS RICH FLAG RESET ?
113
YES
NO
RICH FLAG IS SET
114
F(A/F)←F(A/F)-Kr
121
A ← A + 1
122

METHOD OF AND APPARATUS FOR CONTROLLING AN AIR RATIO OF THE AIR-FUEL MIXTURE SUPPLIED TO AN INTERNAL COMBUSTION ENGINE

DESCRIPTION OF THE INVENTION

The present invention relates to an air-fuel ratio control method in an internal combustion engine.

To simultaneously reduce harmful HC, CO and NOx components in the exhaust gas, it is well known to arrange a three way catalytic converter in the exhaust passage of an engine. The purifying efficiency of the three way catalyzer becomes maximum when the ratio of the air-fuel mixture fed into the cylinders of the engine becomes equal to the stoichiometric air-fuel ratio. Consequently, when a three way catalytic converter is used, it is necessary to obtain an air-fuel ratio as close as possible to the stoichiometric air-fuel ratio.

As a sensor for producing an output related to the air-fuel ratio, an oxygen concentration detector, issuing a rich signal, and a lean signal is commonly arranged in the exhaust passage of the engine, and the rich signal and the lean signal are employed in an electric control unit to generate a control signal. Fuel injectors are actuated by the control signal, and the amount of fuel injected by the fuel injectors is controlled so as to approach a stoichiometric air-fuel ratio.

In such an air-fuel ratio device, when the air-fuel ratio mixture is changed, for example, from the rich side to the lean side of the stoichiometric air-fuel ratio, such a change is detected by the oxygen concentration detector which issues a lean signal. However, usually, there is a time lag until the oxygen concentration detector issues the lean signal after the air-fuel ratio mixture changes from the rich side to the lean side of the stoichiometric air-fuel ratio. Therefore, when the oxygen concentration detector issues the lean signal, the air-fuel ratio is considerably increased relative to the stoichiometric air-fuel ratio. Consequently, in a conventional air-fuel ratio control device, when the output signal of the oxygen concentration detector is changed, for example, from the rich signal to the lean signal, the amount of fuel injected from the fuel injectors is instantaneously increased in such a way that the voltage level of the feedback control signal, used for controlling the opening operation of the fuel injectors, incrementally increases. In addition, in order to obtain the cleanest possible emissions, the mean value of the voltage level of the feedback control signal is normally maintained on the rich side of the reference level capable of equalizing the air-fuel ratio to the stoichiometric air-fuel ratio in such a way that the degree of incremented change produced when the output signal of the oxygen concentration detector changes from the lean signal to the rich signal is greater than the degree of incremental change produced when the output signal of the oxygen concentration detector is changed from the rich signal to the lean signal.

However, in a multi-cylinder engine, when the ratio of the air-fuel mixture fed to each cylinder becomes irregular, a high frequency ripple component is superimposed on the output signal of the oxygen concentration detector. As a result of this, when the low frequency component of the output signal of the oxygen concentration detector approaches a threshold value, the high frequency component causes the output signal to oscillate on opposite sides of the threshold for a short time. When such oscillations occur and the degree by which the air-fuel ratio is changed when the output signal of the oxygen concentration detector changes from the lean signal to the rich signal is greater than that of the degree by which the air-fuel ratio is changed when the output signal of the oxygen concentration detector changes from the rich signal to the lean signal, the mean value of the voltage level of the feedback control signal is considerably offset from the reference level to the rich side thereof and, as a result, a problem occurs in that the quality of the exhaust emission will deteriorate.

An object of the present invention is to provide an air-fuel ratio control method capable of preventing the mean value of the voltage level of the feedback control signal from being offset from a predetermined level to the rich side or the lean side of the reference level, even if the output signal of the oxygen concentration detector is rapidly repeatedly changed from the lean side to the rich side or from the rich side to the lean side of the stoichiometric air-fuel ratio over a short period.

According to the present invention, there is provide a method of and apparatus for controlling an air-fuel ratio of mixture fed into cylinders of an internal combustion. A fuel injector is arranged in an intake passage of the engine, and an oxygen concentration detector is arranged in an exhaust passage of the engine for issuing a rich signal and a lean signal which indicate that the air-fuel ratio of the mixture supplied to the engine is on the rich side or on the lean side of the stoichiometric air-fuel ratio, respectively. An electronic control unit converts the rich signal and the lean signal to an injection control signal having a level which is proportional to the injection time period of the fuel injector. The control signal is incrementally changed by a predetermined first value so as to instantaneously increase the level of the injection control signal when the signal of the oxygen concentration detector is changed from the rich signal to the lean signal. The injection control signal is incrementally changed by a predetermined second value which is different from the first value so as to instantaneously reduce the level of the injection control signal when the signal of the oxygen concentration detector is changed from the lean signal to the rich signal.

The signal of the oxygen concentration detector is monitored for changes from the rich signal to the lean signal or from the lean signal to the rich signal, and the time elapsed from the last change is measured. When a change is detected, the time elapsed is compared with a predetermined time, and the level of the injection control signal is incrementally changed by a value which is equal to a value of the incremental change in the preceding change when the time elapsed exceeds the predetermined time.

The present invention may be more fully understood from the description of a preferred embodiment of the invention set forth below, together with the accompanying drawings.

DESCRIPTION OF A PREFERRED EMBODIMENT

Figure 1:
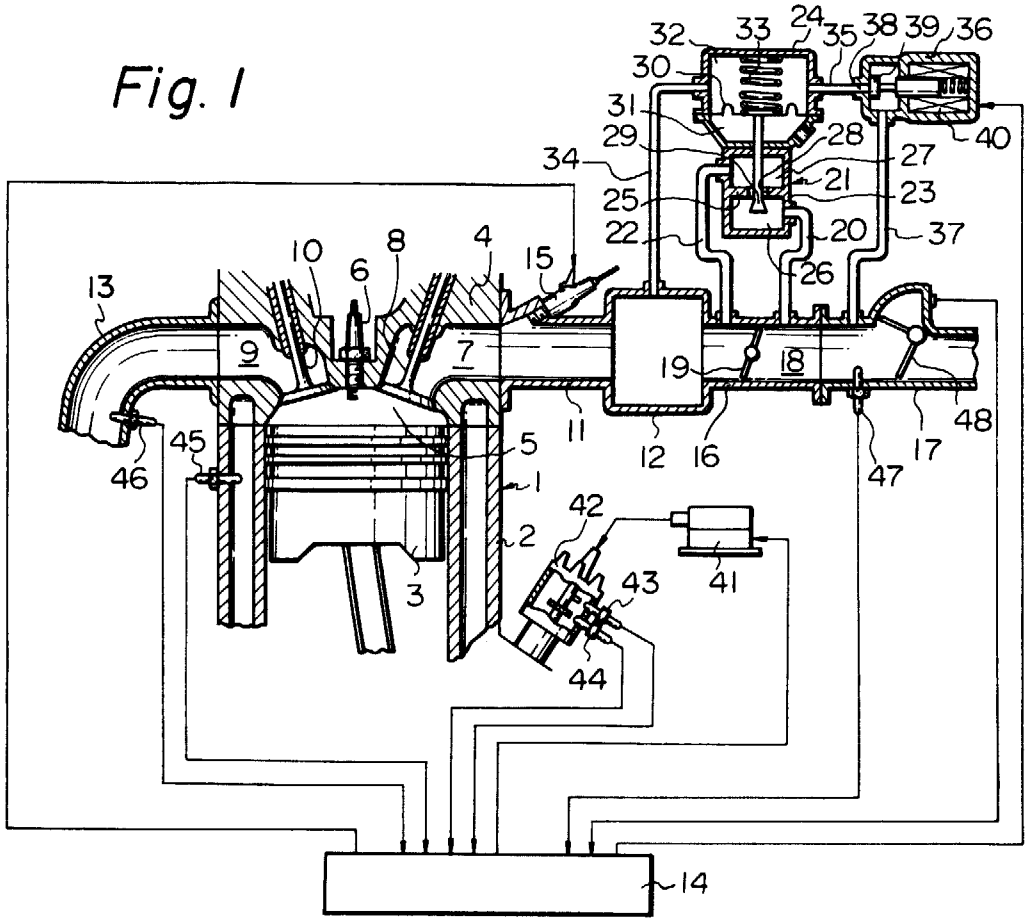
FIG. 1 is a cross-sectional side view of an internal combustion engine.

Referring to FIG. 1, 1 designates an engine body, 2 a cylinder block, 3 a piston reciprocally movable in the cylinder block, and 4 a cylinder head fixed onto the cylinder block 2; 5 designates a combustion chamber formed between the piston 3 and the cylinder head 4, 6 a spark plug arranged in the combustion chamber 5, 7 an intake port, and 8 an intake valve; 9 designates an exhaust port, and 10 an exhaust valve.

The intake port 7 is connected via the corresponding branch pipe 11 to a surge tank 12 which is common to all the cylinders, and the exhaust port 9 is connected to an exhaust manifold 13. A fuel injector 15, which is controlled by an electronic control unit 14, is provided for each cylinder and mounted on the corresponding branch pipe 11, and fuel is injected into each of the intake ports 7 from the corresponding fuel injector 15. The surge tank 12 is connnected to the atmosphere via an intake pipe 16, an air flow meter 17 and an air cleaner (not shown). A throttle valve 19 is arranged in an intake passage 18 formed in the intake pipe 16 and connected to an accelerator pedal (not shown) arranged in the driver's compartment.

A bypass passage 20, having a cross-sectional area which is smaller than that of the intake pipe 18, branches off from the intake passage 18 located upstream of the throttle valve 19, and the bypass passage 20 is connected via a flow control device 21 and a bypass passage 22 to the intake passage 18 located downstream of the throttle valve 19. The flow control device 21 comprises a valve apparatus 23 and a diaphragm apparatus 24. The valve apparatus 23 has an air inflow chamber 26 and an air outflow chamber 27 which are separated by a partition 25. The bypass passage 20 is connected to the air inflow chamber 26, and the bypass passage 22 is connected to the air outflow chamber 27. A valve port 28 is formed on the partition 25, and a control valve 29 for controlling the flow area of the valve port 28 is arranged in the valve port 28.

The diaphragm apparatus 24 comprises an atmospheric pressure chamber 31 and a vacuum chamber 32 which are separated by a diaphragm 30, and the control valve 29 is connected to the diaphragm 30. A compression spring 33 is arranged in the vacuum chamber 32 for biasing the diaphragm 30 towards the atmospheric pressure chamber 31, and the vacuum chamber 32 is connected to the surge tank 12 via a vacuum conduit 34.

In addition, the vacuum chamber 32 is connected to the air flow meter 17 via an air bleed conduit 35, an electromagnetic valve 36 and an air bleed conduit 37. The electromagnetic valve 36 comprises a valve body 39 for alternately opening and closing a valve port 38, and a solenoid 40 for actuating the valve body 39. The energizing operation of the solenoid 40 is controlled by the electronic control unit 14. When the solenoid 40 is deenergized, the valve body 39 closes the valve port 38, as illustrated in FIG. 1. When the solenoid 40 is energized, the valve body 39 opens the valve port 38. Continuous control pulses are applied to the solenoid 40 from the electronic control unit 14, and the opening duration of the valve port 38 is controlled by changing the duty cycle of the continuous control pulses. The pressure in the air flow meter 17 is approximately equal to the atmospheric pressure and, therefore, when the valve body 39 opens the valve port 38, air is fed into the vacuum chamber 32 via the air bleed conduits 35, 37. As a result of this, since the level of the vacuum produced in the vacuum chamber 32 becomes small, the diaphragm 30 moves downward. Therefore, the flow area of the valve port 28 is increased and, thus, the amount of air flowing within the bypass passages 20 and 22 is increased. As the control pulses reaching the solenoid 40 become more numerous, that is, as the amount of air fled into the vacuum chamber 32 becomes larger, the level of the vacuum produced in the vacuum chamber 32 becomes smaller. Consequently, it will be understood that, as the control pulses reaching the solenoid 40 become more numerous, the amount of air flowing within the bypass passages 20 and 22 increases.

Referring to FIG. 1, an ignitor 41, controlled by the electronic control unit 14, is provided and, in addition, a distributor 42, distributing the ignition signal issued from the ignitor 41 to the spark plugs 6, is also provided. A cylinder discriminating sensor 43, for discriminating the cylinder to be ignited, and a rotating speed sensor 44, for detecting the rotating speed of the crank shaft (not shown) of the engine, are arranged in the distributor 42 and connected to the electronic control unit 14. A water temperature sensor 45, for detecting the temperature of the cooling water of the engine, is mounted on the cylinder block 2, and an oxygen concentration detector 46 is arranged in the exhaust manifold 13. The water temperature sensor 45 and the oxygen concentration detector 46 are connected to the electronic control unit 14. The oxygen concentration detector 46 produces an ouput voltage of about 0.1 volt, that is, issues a lean signal when the ratio the air-fuel mixture fed into the cylinders is larger than the stoichiometric air-fuel ratio, while the oxygen concentration detector 46 produces an output voltage of about 0.9 volt, that is, issues a rich signal when the ratio of the air-fuel mixture fed into the cylinders is smaller than the stoichiometric air-fuel ratio.

As illustrated in FIG. 1, and air temperature sensor 47, for detecting the temperature of air sucked into the cylinders, is arranged in the air flow meter 17, and the air flow meter 17 and the air temperature sensor 47 are connected to the electronic control unit 14. The air flow meter 17 has a metering plate 48 rotating in accordance with an increase in the amount of air, and the rotating angle of the metering plate 48 is converted to an output voltage. This output voltage is proportional to the amount of air and is fed into the electronic control unit 14.

Figures 2, 2A, 2B:
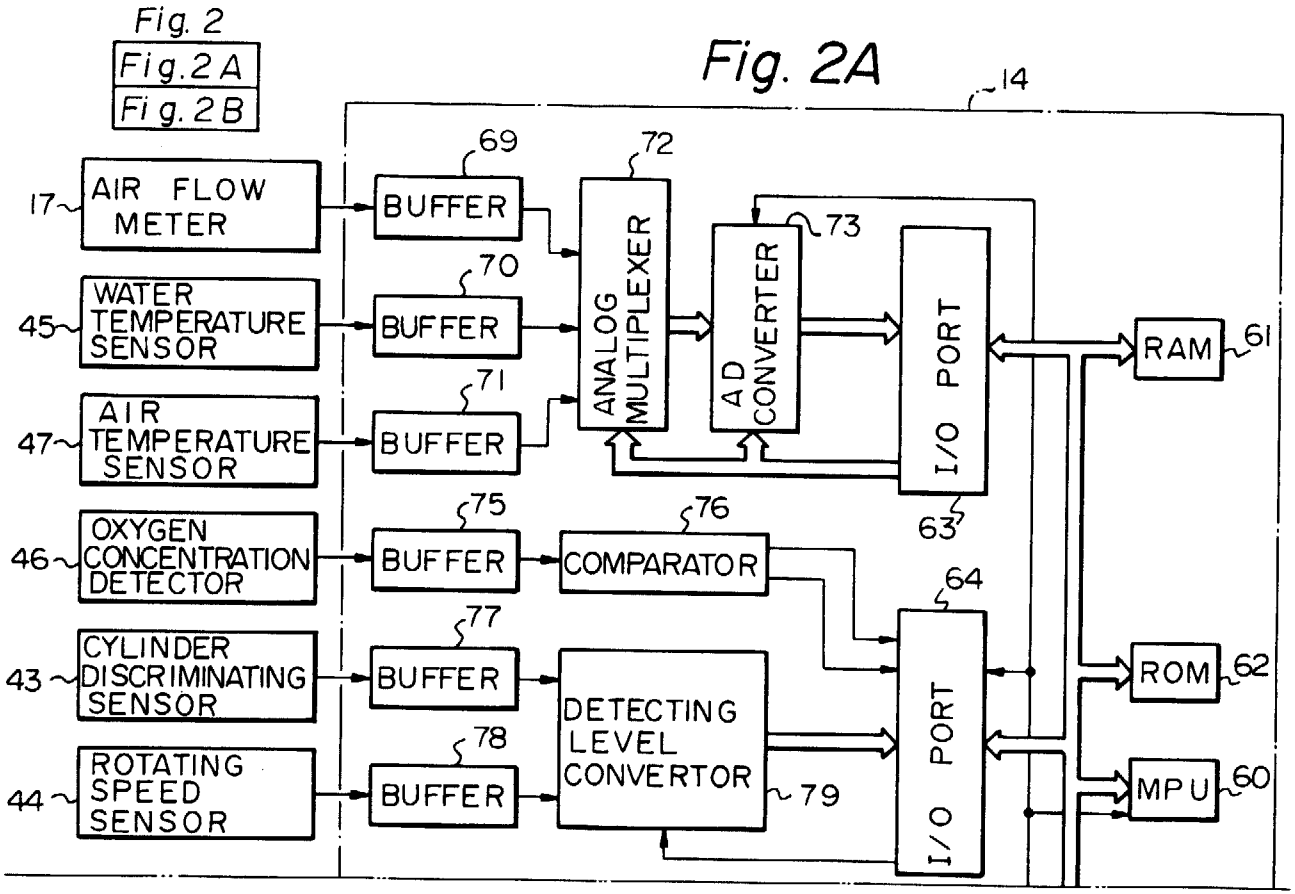
FIGS. 2A and 2B is a circuit diagram of the electronic control unit illustrated in FIG. 1.
Figure 2B:
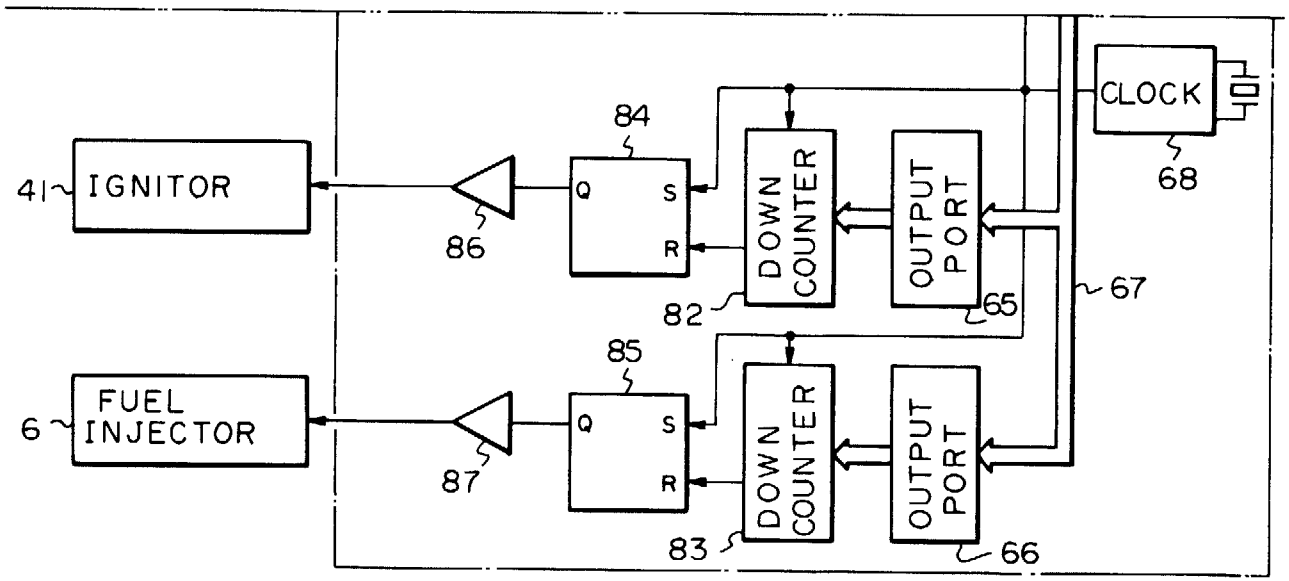

FIG. 2 illustrates the electronic control unit 14. Referring to FIG. 2, the electronic control unit 14 is constructed as a digital computer and comprises a microprocessor (MPU) 60 carring out the arithmetic and logic processing, a random-access memory (RAM) 61, a read-only memory (ROM) 62 storing a predetermined control program and arithmetic constant therein, a pair of input/output ports 63, 64 and a pair of output ports 65, 66. The MPU 60, the RAM 61, the ROM 62, the input/output ports 63, 64 and the output ports 65, 66 are interconnected to each other via a bidirectional bus 67.

In addition, the electronic control unit 14 comprises a clock generator 68 generating various clock signals.

As illustrated in FIG. 2, the output signals of the air flow meter 17, the water temperature sensor 45 and the air temperature sensor 47 are fed into an analog multiplexer 72 via buffer amplifiers 69, 70 and 71, respectively. In the analog multiplexer 72, one output signal selected from the above-mentioned three output signals, and the output signal thus selected is fed into an AD converter 73. As mentioned above, the air flow meter 17 produces an output voltage which is proportional to the amount of air fed into the cylinders. The output voltage of the air flow meter 17 is converted to the corresponding binary code in the AD converter 73 and, then, this binary code is inputted into the MPU 60 via the input/output port 63 and the bus 67. The water temperature sensor 45 and the air temperature sensor 47 comprise, for example, a thermister element and produce output voltages are proportional to the temperature of the cooling water of the engine and the temperature of the air fed into the cylinders, respectively. The output voltages of the water temperature sensor 45 and the air temperature sensor 47 are converted to the corresponding binary codes in the AD converter 73, and the binary codes are inputted into the MPU 60 via the input/output port 63 and bus 67.

The output signal of the oxygen concentration detector 46 is inputted into the comparator 76 via a buffer amplifier 75 and, in the comparator 76, the output voltage of the oxygen concentration detector 46 is compared with a reference voltage of about 0.4 volt. When the output voltage of the oxygen concentration detector 46 is lower than the reference voltage, that is, when the oxygen concentration detector 46 issues the lean signal, the output voltage, produced at one of the output terminals of the comparator 76, becomes high level. When the output voltage of the oxygen concentration detector 46 is higher than the reference voltage, that is, when the oxygen concentration detector 46 issues the rich signal, the output voltage, produced at the other output terminal of the comparator 76, becomes high level. The output voltage of the comparator 76 is input into the MPU 60 via the input/output port 64 and the bus 67 and, thus, the output signal of the oxygen concentration detector 46 is always monitored by the MPU 60.

The output signals of the cylinder discriminating sensor 43 and the rotating speed sensor 44 are inputted into a detecting level converter 79 via corresponding AD converters 77 and 78. In the embodiment illustrated in FIG. 1, a group injection system is adopted in which the fuel injection system is divided into two systems, and the injecting operation of fuel is independently carried out for each system. The cylinder discriminating sensor 43 produces a pulse signal indicating the system in which the injecting operation of fuel is carried out, and the pulse signal of the cylinder discriminating sensor 43 is inputted into the detecting level converter 79. The rotating speed sensor 44 produces a pulse everytime the crank shaft rotates by a fixed angle, and the pulse of the rotating speed sensor 44 is input into the detecting level converter 79. The voltage level of the output signals of the cylinder discriminating sensor 43 and the rotating speed sensor 44 is increased as the rotating speed of the engine is increased. However, if the rotating speed of the engine is increased, a high frequency noise signal is produced in the output signals of the cylinder discriminating sensor 43 and the rotating speed sensor 44. Consequently, when the rotating speed of the engine is increased, it is necessary to eliminate such a high frequency noise signal. To this end, the detecting level converter 79 is provided. That is, the detecting level converter 79 is so constructed that the threshold level thereof is increased as the rotating speed of the engine is increased. As a result of this, the high frequency noise signal is eliminated and, in addition, even when the engine is rotating at a low speed, the output signals of the cylinder discriminating sensor 43 and the rotating speed sensor 44 are assuredly inputted into the MPU 60 via the input/output port 64 and the bus 67.

The output ports 65 and 66 are provided for outputting data necessary to actuate the ignitor 41 and the fuel injector 15, respectively, and binary coded data is written in the output ports 65, 66 from the MPU 60 via the bus 67. The output terminals of the output port 65 and connected to the corresponding input terminals of a down counter 82, and the output terminals of the output port 66 are connected to the corresponding input terminals of a down counter 83. The down counters 82 and 83 are provided for converting the binary coded date, written in the output ports 65 and 66, to the corresponding length of time. That is, the down count of the binary coded data fed into the down counters 82, 83 from the output ports 65, 66 is started by the clock signal of the clock generator 68. After this, when the content of the down counters 82 and 83 becomes equal to zero, the down count of the binary coded data is completed, and the down count completion signal is produced at the output terminals of the down counters 82 and 83.

The reset input terminals R of the S-R flip-flops 84 and 85 are connected to the output terminals of the down counters 82 and 83, respectively, and the set input terminals S of the S-R flip-flops 84 and 85 are connected to the clock generator 68. The S-R flip-flops 84 and 85 are set by the clock signal of the clock generator 68 at the same time the down count of the down counters 82, 83 is started, and the S-R flip-flops 84 and 85 are reset by the down count completion signal of the down counters 82, 83 at the same time of the completion of the down count of the down counters 82 and 83. Consequently, the output voltage, produced at the output terminals Q of the flip-flops 84, 85, becomes high level during the time the down count of the down counters 82 and 83 is carried out. The output terminal Q of the flip-flop 84 is connected to the ignitor 41 via a power amplifying circuit 86, and the output terminal Q of the flip-flop 85 is connected to the fuel injector 6 via a power amplifying circuit 87. Consequently, it will be understood that the fuel injector 6 is actuated during the time the down count of the down counter 83 is carried out. On the other hand, the feeding of electric current fed into the primary coil arranged in the ignitor 41 is started by the leading edge signal of the pulse produced at the output terminal Q of the flip-flop 84, and the feeding of the electric current is shut off by the trailing edge signal of the pulse produced at the output terminal Q of the flip-flop 84. When the feeding of the electric current is shut off as mentioned above, the secondary coil, arranged in the ignitor 41, generates a high voltage, and this high voltage is applied to the spark plug 6 (FIG. 1) via the distributor 42.

The electromagnetic valve 36, illustrated in FIG. 1, is omitted in FIG. 2. The electromagnetic valve 36 is provided for maintaining the rotating speed of the engine at a predetermined speed at the time of idling. That is, the amount of air fed into the cylinders via the bypass passages 20 and 22 is controlled by changing the duty cycle of the pulses applied to the electromagnetic valve 36 so that the rotating speed of the engine becomes equal to a predetermined speed at the time of idling.

The fuel injection time period T is essentially indicated as follows.

$$T = Tp \cdot F(A/F) \cdot K + Ta$$

where

Tp: basic fuel injection time period.

F(A/F): feedback correction value determined by temperature, such as the temperature of air fed into the cylinders.

Ta: ineffective fuel injection time period.

The basic fuel inejction time period T is determined by the amount of air fed into the cylinders and the number of revolutions per minute of the engine. That is, in the MPU 60, the number of revolutions per minute of the engine is calculated from the output signal of the rotating speed sensor 44 and, also in the MPU 60, the basic fuel injection time period $T_p$ is calculated from the calculated number of revolutions per minute of the engine and the output signal of the air flow meter 17.

The correction value K is obtained from the output signal of the water temperature sensor 45 and the output signal of the air temperature sensor 47. That is, the functions, representing the desired relationships between the correct value K and the temperature of the cooling water of the engine and between the correction value K and the temperature of the air fed into the cylinders, are stored in the ROM 62 in the form of an arithmetic equation or a data table and, thus, the correction value K is obtained from the output signal of the water temperature sensor 45 and the output signal of the air temperature sensor 47 by using the functions stored in the ROM 62.

Figure 4:
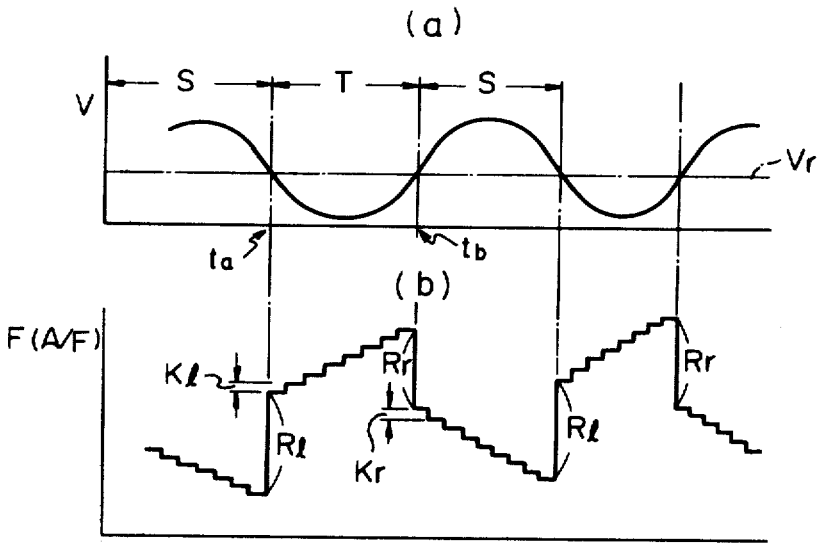
FIG. 4 is a schematic diagram of the output signal of the oxygen concentration detector and the feedback correction coefficient.

The feedback correction coefficient F(A/F) is obtained by the output signal of the oxygen concentration detector 46. Referring to FIG. 4, FIG. 4(*a*) indicates the output signal of the oxygen concentration detector 46, and FIG. 4(*b*) indicates the feedback correction coefficient F(A/F). In addition, in FIG. 4(*a*), Vr indicates the reference voltage of the comparator 76. As mentioned previously, when the output voltage of the oxygen concentration detector 46 is higher than the reference voltage Vr, as indicated by the section S in FIG. 4(*a*), the rich signal is input into the MPU 60, and when the output voltage of the oxygen concentration detector 46 is lower than the reference voltage Vr, as indicated by the section T in FIG. 4(*a*), the lean signal is inputted into the MPU 60. When the output signal of the oxygen concentration detector 46 is changed from the rich signal to the lean signal, as indicated at the time Ta in FIG. 4, the feedback correction coefficient F(A/F) is instantaneously increased by a predetermined increment Rl and, then, during the time the oxygen concentration detector 46 issues the lean signal, a predetermined integrating value Kl is successively added to the feedback correction coefficient F(A/F). After this, when the output signal of the oxygen concentration detector 46 is changed from the lean signal to the rich signal, as indicated at time Tb in FIG. 4(*a*), the feedback correction coefficient F(A/F) is instantaneously reduced by a predetermined increment Rr and, then, during the time the oxygen concentration detector 46 issues the rich signal, a predetermined integrating value Kr is successively substracted from the feedback correction coefficient F(A/F). As illustrated in FIG. 4(*b*), the change increment Rl is larger than the change increment Rr, and the integrating value Kl is larger than the integrating value Kr.

The ineffective fuel injection time period Ta is stored in the ROM 62 and, thus, the fuel injection time period $T = Tp \cdot F(A/F) \cdot K + Ta$ is calculated in the MPU 60. The fuel injection time period T thus calculated is written in the output port 66 (FIG. 2) in the form of binary coded data. From FIG. 4, it will be understood that, when the oxygen concentration detector 46 issues a lean signal, since the fuel injection time period T is increased, the amount of fuel injected from the fuel injector 15 (FIG. 1) is increased, and that, when the oxygen concentration detector 46 issues a rich signal, since the fuel injection time period T is reduced, the amount of fuel injected from the fuel injector 15 is reduced.

Figure 5:
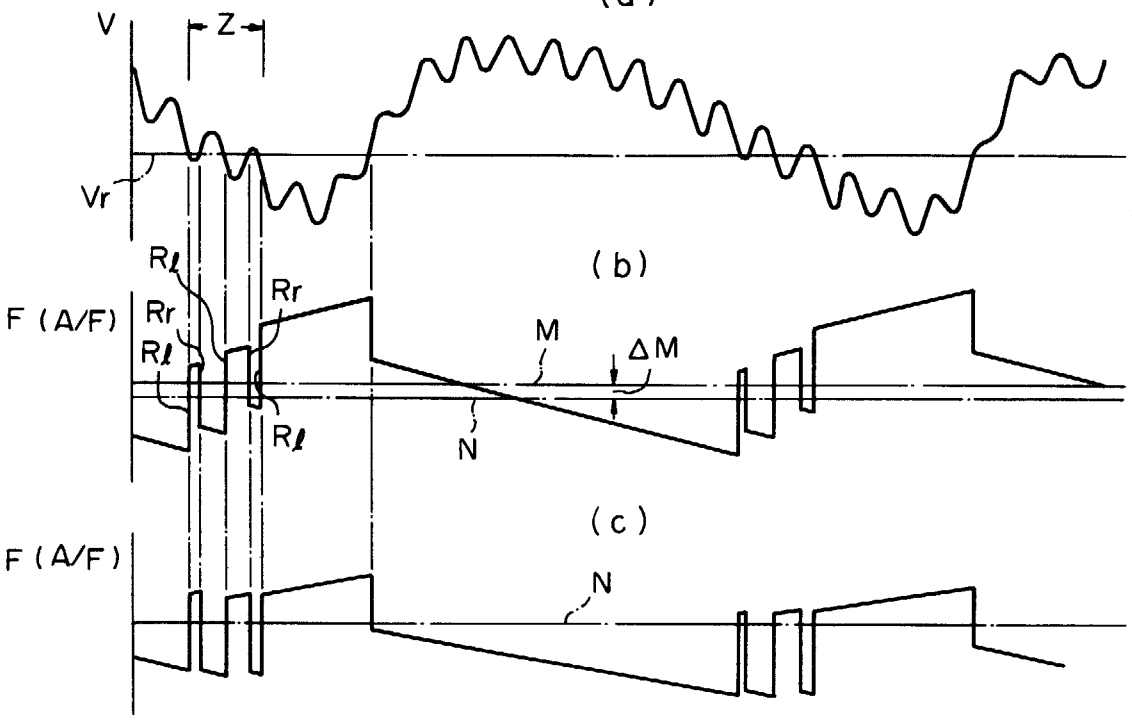
FIG. 5 is a practical diagram of the output signal of the oxygen concentration detector and the feedback correction coefficient.

FIG. 4 schematically illustrates the output signal of the oxygen concentration detector 46. A more realistic example of the output signal of the oxygen concentration detector 46 changes as illustrated in FIG. 5(*a*). That is, when the air-fuel ratio of the mixture fed into each cylinder becomes irregular, a high frequency ripple component is superimposed on the output signal of the oxygen concentration detector 46 as illustrated in FIG. 5(*a*). In FIG. 5(*a*), Vr indicates the reference voltage of the comparator 76 (FIG. 2). As illustrated in FIG. 5, in the section Z the output signal of the oxygen concentration detector 46 rapidly changes from the rich signal to the lean signal. That is, the voltage level of the output signal of the oxygen concentration detector 46 repeatedly crosses the reference voltage Vr due to the presence of the high frequency ripple component. As a result of this, as illustrated in FIG. 5(*b*), in a conventional air-fuel ratio control method, the increment Rl and the increment Rr are alternately repeated. However, if the increment Rl and the increment Rr are alternately repeated, as mentioned above, since the increment Rl is larger than the increment Rr, the feedback correction coefficient F(A/F) is increased as a whole and, as a result, a problem occurs in that the mean value M of the feedback correction coefficient F(A/F) is increased by a value ΔM relative to a predetermined mean value N. According to the present invention, such a problem is eliminated.

Figures 3, 3A, 3B:
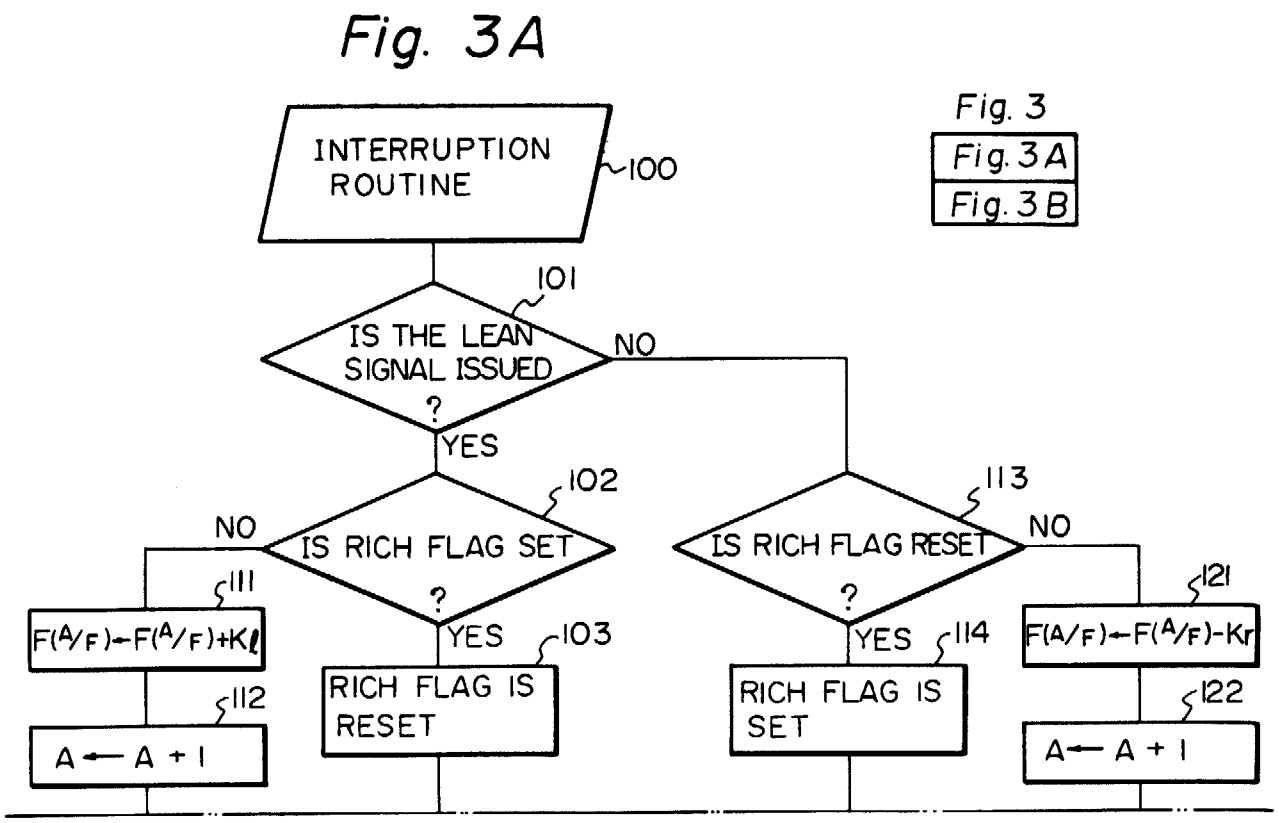
FIGS. 3A and 3B is a flow chart illustrating an operation according to the present invention.
Figure 3B:
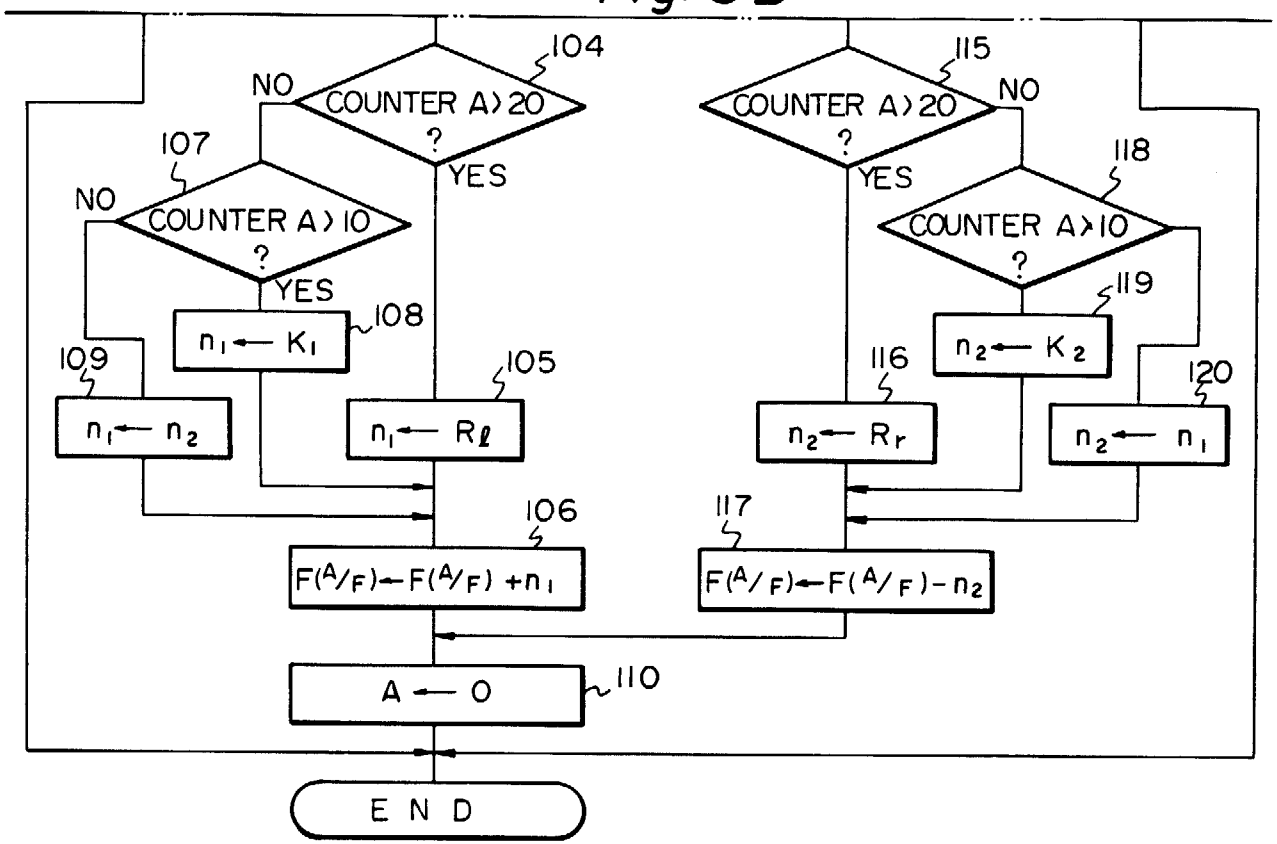

The operation of the electronic control unit 14 will be hereinafter described with reference to FIG. 3. Referring to FIG. 3, step 100 means that the routine is processed by sequential interruptions which are executed every predetermined time. This interruption is executed, for example, every 5 msec. Firstly, in step 101, it is determined whether the oxygen concentration detector 46 issues the lean signal on the basis of the output signal of the oxygen concentration detector 46. If the oxygen concentration detector 46 issues the lean signal, in step 102, it is determined whether the rich flag, which is set when the oxygen concentration detector 46 issues the rich signal as hereinafter described, is set. If the rich flag is set, in step 103, the rich flag is reset. Consequently, step 103 is executed when the rich flag remains set from the preceding processing cycle and the oxygen concentration detector 46 issues the lean signal in the present processing cycle, that is, when the output signal of the oxygen concentration detector 46 changes from the rich signal to the lean signal. After the rich flag is reset in step 103, it is determined whether the content of the counter A is larger than 20 in step 104. If the content of the counter A is larger than 20, in step 105, the skip degree Rl, illustrated in FIG. 4, is put into $n_1$. On the other hand, if it is determined that the content of the counter A is not larger than 20 in step 104, it is determined whether the content of the counter A is larger than 10 in step 107. If the content of the counter A is larger than 10, in step 108, a fixed value $K_1$ is put into $n_1$. If it is determined that the content of the counter A is not larger than 10, in step 109, $n_2$ is put into $n_1$. In step 106, $n_1$ is added to the feedback correction coefficient F(A/F), and the result, obtained by addition, is put into F(A/F). Consequently, if the processing in step 106 is executed, the feedback correction coefficient F(A/F) is increased by $n_1$. After this, in step 110, zero is put into the content of the counter A and, then, the processing cycle is completed.

In the next processing cycle, if the oxygen concentration detector 46 issues a lean signal, since the rich flag has been reset in step 103 in the preceding processing cycle, in step 102, it is determined that the rich flag is not set. Therefore, at this time, in step 111, the integrating value Kl, illustrated in FIG. 4, is added to the feedback correction coefficient F(A/F), and the result, obtained by addition, is put into the F(A/F). After this, in step 112, the content of the counter A is incremented by one and, then, the processing cycle is completed. In next processing cycle, if the oxygen concentration detector 46 still issues a lean signal, in step 111, the integrating value Kl is added again to the feedback correction coefficient F(A/F). Consequently, during the time the oxygen concentration detector 46 issues the lean signal, F(A/F) is gradually increased. In addition, during the time the oxygen concentration detector 46 issues the lean signal, in step 112, the increment of the content of the counter A continues and, therefore, the content of the counter A is gradually increased. Therefore, it will be understood that the content of the counter A represents the time elasped from the moment when the output signal of the oxygen concentration detector 46 is changed from the rich signal to the lean signal.

On the other hand, if it is determined that the oxygen concentration detector 46 issues a rich signal in step 101, it is determined whether the rich flag is reset in step 113. If the rich flag is reset, in step 114, the rich flag is set. Consequently, the processing in step 114 is executed when the rich flag remains reset from the preceding processing cycle and the oxygen concentration detector 46 issues the rich signal in the present processing cycle, that is, when the output signal of the oxygen concentration detector 46 is changed from the lean signal to the rich signal. After the rich flag is set in setp 114, it is determined whether the content of the counter A is larger than 20 in step 115. If the content of the counter A is larger than 20, in step 116, the increment Rr, illustrated in FIG. 4, is put into $n_2$. On the other hand, if it is determined that the content of the counter A is not larger than 20 in step 115, it is determined whether the content of the counter A is larger than 10 in step 118. If the content of the counter A is larger than 10, in step 119, a fixed value $K_2$ is into $n_2$. Contrary to this, if it is determined that the content of the counter A is not larger than 10, in step 120, $n_1$ is put into $n_2$. In step 117, $n_2$ is subtracted from the feedback correction coefficient F(A/F), and the result, obtained by subtraction, is put into F(A/F). Consequently, if the processing in step 117 is executed, the feedback correction coefficient F(A/F) is reduced by $n_2$. After this, in step 110, zero is put into the content of the counter A and, then, the processing cycle is completed.

In the next processing cycle, if the oxygen concentration detector 46 issues the rich signal, since the rich flag has been set in step 114 in the preceding processing cycle, in step 113, it is determined that the rich flag is not reset. Therefore, at this time, in step 121, the integrating value Kr, illustrated in FIG. 4, is subtracted from the feedback correction coefficient F(A/F), and the result, obtained by subtraction, is put into the F(A/F). After this, in step 122, the content of the counter A is incremented by one and, then, the processing cycle is completed.

In FIG. 3, the incremental values Rl and Rr and the integrating values Kl and Kr are predetermined fixed values and are stored in the ROM 62. In addition, the incremental values $K_1$ and $K_2$ are smaller than the incremental value Rl, but are larger tahn the incremental value Rr. As mentioned previously, the content of the counter A is steps 104 and 107 represents the time elapsed from the moment when the output signal of the oxygen concentration detector 46 is changed from the rich signal to the lean signal. As will be understood from FIG. 3, when the content of the counter A is larger than 20, that is when the time elapse of A is long, the incremental change becomes equal to Rl. In addition, when the content of the counter A is not larger than 20, but is larger than 10, the incremental change becomes equal to $K_1$ which is smaller than Rl. Furthermore, when the content of the counter A is not larger than 10, that is, when the time elapse of A is short, the incremental change becomes equal to the incremental change $n_2$ which is used when the output signal of the oxygen concentration detector 46 is the latest change from the lean signal to the rich signal. Contrary to this, the content of the counter A in steps 115 and 118 represents the time elapsed from the moment when the output signal of the oxygen concentration detector 46 is changed from the lean signal to the rich signal. Also as will be understood from FIG. 3, when the content of the counter A is larger than 20, that is, when the time elapse of A is long, the incremental change becomes equal to Rr. In addition, when the content of the counter A is not larger than 20, but is larger than 10, the incremental change becomes equal to $K_2$ which is larger than Rr. Furthermore, when the content of the counter A is not larger than 10, that is, when the time elapse of A is short, the incremental change becomes equal to the incremental change $n_1$ which is used when the output signal of the oxygen concentration detector 46 is the latest change from the rich signal to the lean signal.

Consequently, in the case wherein the voltage level of the output signal of the oxygen concentration detector 46 is repeatedly increased and reduced for short periods, as illustrated in the section Z in FIG. 5(*a*), during this time all the incremental changes become equal to $n_2$. Therefore, even if the voltage level of the output signal of the oxygen concentration detector 46 is repeatedly increased and reduced for a short time, there is no danger that the mean value of the feedback correction coefficient F(A/F) will be offset from the desired mean value N. As a result of this, since the air-fuel ratio of mixture fed into the cylinders is always equal to a predetermined air-fuel ratio, it is possible to obtain a good exhaust emission.

While the invention has been described by reference to a specific embodiment chosen for purposes of illustration, it should be apparent that numerous modifications could be made thereto by those skilled in the art without departing from the basic concept and scope of the invention.

I claim:

1. A method of controlling a ratio of the air-fuel mixture fed into cylinders of an internal combustion engine comprising a fuel injector arranged in an intake passage of the engine, an oxygen concentration detector arranged in an exhaust passage of the engine and issuing a rich signal and a lean signal which indicate that the air-fuel ratio of a mixture is on the rich side and on the lean side of the stoichiometric air-fuel ratio, respectively, and an electronic control unit converting the rich signal and the lean signal to an injection control signal having a level which is proportional to the injection time period of the fuel injector, said injection control signal being incrementally increased by a predetermined first value when the signal of the oxygen concentration detector changes from the rich signal to the lean signal, and being incrementally decreased by a predetermined second value which is different from the first value when the signal of the oxygen concentration detector changes from the lean signal to the rich signal, said method comprising the steps of:

detecting a change in the output of the oxygen concentration detector from the rich signal to the lean signal or from the lean signal to the rich signal;

measuring the time elapsed from one change to a next change of said oxygen concentration detector output;

comparing said time elapsed with a predetermined time; and changing the level of the injection control signal by a value which is equal to a value of the incremental change of said injection control signal in response to the preceding change of the sinal of the oxygen concentration detector when said time elapsed is shorter than said predetermined time.

2. A method as claimed in claim 1, wherein said first value is larger than said second value.

3. A method as claimed in claim 2, wherein said first value and said second value are fixed values.

4. A method as claimed in claim 2, wherein said first value and said second value are changed in accordance with the length of said time elapsed.

5. A method as claimed in claim 4, wherein said predetermined time comprises a first fixed time and a second fixed time, which is shorter than said first fixed time, said first value comprising a primary fixed value and a secondary fixed value, which is smaller than said primary fixed value, the level of the injection control signal being incrementally changed by said primary fixed value when said time elapsed is shorter than said first fixed time, but is not shorter than said second first fixed time, but is not shorter than said second fixed time, the level of the injection control signal being incrementally changed by said secondary fixed value when said time elapsed is shorter than said second fixed time.

6. A method as claimed in claim 4, wherein said predetermined time comprises a first fixed time and a second fixed time, which is shorter than said first fixed time, said second value comprising a primary fixed value and a secondary fixed value which is larger than said primary fixed value, the level of the injection control signal being incrementally changed by said primary fixed value when said time elapsed is shorter than said first fixed time, but is not shorter than said second fixed time, the level of the injection control signal being incrementally changed by said secondary fixed value when said time elapsed is shorter than said second fixed time.

7. A method as claimed in claim 1, wherein the level of the injection control signal is gradually increased and reduced during the time the oxygen concentration detector issues the rich signal and the lean signal, respectively.

8. Apparatus for controlling a ratio of the air-fuel mixtures fed into cylinders of an internal combustion engine comprising:

a fuel injector arranged in an intake passage of said engine;

an oxygen concentration detector arranged in an exhaust passage of the engine for issuing a rich signal and a lean signal which indicate that the air-fuel ratio of a mixture supplied to said engine is on the rich side and on the lean side of the stoichiometric air-fuel ratio, respectively; and an electronic control means, responsive to said oxygen concentration detector for converting said rich and lean signals to an injection control signal having a level which is proportional to the injection time period of the fuel injector, said electronic control means also for: (1) incrementally increasing by a predetermined first value the level of said injection control signal when the signal of said oxygen concentration detector changes from the rich signal to the lean signal, (2) incrementally decreasing by a predetermined second value which is different from the first value said injection control signal when the signal of the oxygen concentration detector changes from the lean signal to the rich signal, (3) detecting a change in the output of the oxygen concentration detector between the rich and lean signals, (4) measuring the time elapsed from one change to a next change of said oxygen concentration detector output, (5) comparing said time elapsed with a predetermined time, and (6) changing the level of the injection control signal by a value which is equal to the value of the incremental change of said injection control signal in response to the preceding change of the signal of the oxygen concentration detector when said time elapsed is shorter than said predetermined time.

9. Apparatus as in claim 8, wherein said first value is larger than said second value.

10. Apparatus as in claim 9, wherein said first value and said second value are fixed values.

11. A method as claimed in claim 9, wherein said electronic control means changes said first and second values in accordance with the length of said time elapsed.

12. Apparatus as claimed in claim 11, wherein said predetermined time comprises a first fixed time and a second fixed time, which is shorter than said first fixed time, and said first value comprises a primary fixed value and a secondary fixed value, which is smaller than said primary fixed value, said electronic control means incrementally changing the level of said injection control signal by said primary fixed value when said time elapsed is shorter than said first fixed time, but is not shorter than said second fixed time and incrementally changing the level of said injection control signal by said secondary fixed time when said elapsed time is shorter said second fixed time.

13. Apparatus as claimed in claim 11, wherein said predetermined time comprises a first fixed time and a second fixed time, which is shorter than said first fixed time, and said second value comprises a primary fixed value and a secondary fixed value which is smaller than said primary fixed value, said electronic control means incrementally changing the level of said injection control signal by said primary fixed value when said time elapsed is shorter than said first fixed time, but is not shorter than said second fixed time, and incrementally changing the level of said injection control signal by said secondary fixed value when said elapsed time is shorter said second fixed time.

14. Apparatus as claimed in claim 8, wherein said electronic control means gradually increases and decreases the level of said injection control signal during the time the oxygen concentration detector issues the rich signal and the lean signal, respectively.

* * * * *